US006588362B1

(12) United States Patent
Cope

(10) Patent No.: US 6,588,362 B1
(45) Date of Patent: Jul. 8, 2003

(54) FITTING BRACKET FOR USE ON BOAT AND OTHER STRUCTURE

(76) Inventor: David M. Cope, 4903 Hill Dr., Godfrey, IL (US) 62035

( * ) Notice: Subject to any disclaimer, the term of this patent is extended or adjusted under 35 U.S.C. 154(b) by 0 days.

(21) Appl. No.: 10/040,723

(22) Filed: Jan. 7, 2002

(51) Int. Cl.[7] ..... B63B 17/00
(52) U.S. Cl. ..... 114/364; 114/361
(58) Field of Search ..... 114/361, 364

(56) References Cited

U.S. PATENT DOCUMENTS

| | | | |
|---|---|---|---|
| 3,422,829 | A | 1/1969 | Adams, Jr. |
| 3,978,610 | A | 9/1976 | Stubbman |
| 4,878,642 | A | 11/1989 | Kirby, Jr. |
| 4,979,456 | A | 12/1990 | Steward |
| 5,005,793 | A | 4/1991 | Shillington |
| 5,069,416 | A | 12/1991 | Ennis |
| 5,167,353 | A | 12/1992 | Hughes |
| 5,356,107 | A | 10/1994 | Sinohuiz |
| 5,642,557 | A | 7/1997 | Clows |
| 5,697,591 | A | 12/1997 | Cooper |
| 5,704,576 | A | 1/1998 | Meeker et al. |
| 5,857,477 | A | 1/1999 | James |
| 5,887,539 | A | 3/1999 | Rex et al. |

OTHER PUBLICATIONS

Cabela's2000 Annual Spring Catalogue, p. 82, Cover Support Bow Rail Connectors, Item C, Part. No. AA–01–0465.

*Primary Examiner*—Jesus D. Sotelo
(74) *Attorney, Agent, or Firm*—Paul M. Denk

(57) ABSTRACT

A fitting bracket, which may be compiled from one or a pair of interconnecting Tees, may include the application and securement of a cap, for accommodating a fastener for holding any type of a lamp to the bracket for its application to the side rail of a boat, for securement to the supporting structure of a vehicle, or any other tubular support. The pair of such Tees may be combined together, perpendicularly arranged, so that the lower modified T may snap onto the side rail of, for example, a boat, while the upper T may accommodate the insertion of the handle of a rod and reel or other fishing pole therein, during usage. In addition, a singular Tee may be modified for snap bracketing onto the side rail of a boat, and hold other framework that forms a grid work of frames over and above the boat, for supporting covering material, camouflaged cloth, or any other type of protective covering.

6 Claims, 3 Drawing Sheets

FITTING BRACKET FOR USE ON BOAT AND OTHER STRUCTURE

STATEMENT REGARDING FEDERALLY SPONSORED RESEARCH OR DEVELOPMENT

Not Applicable.

BACKGROUND OF THE INVENTION

This invention relates principally to a bracket, that may be applied to the gunnels of a boat, or any other supporting structure, and for use for securely holding or supporting other accessories such as a lamp, fishing rod, or any other structural framework, for use for facilitating the overall convenient usage of the vehicle.

Various styles of brackets have long been used in the art for holding other items. Brackets and frameworks have had known usage in the boat field, for use for holding frameworks, for supporting camouflage, as for example when used for a duck blind, or supporting other covers, as for enclosure and covering purposes. In addition, brackets have long been used for securement to other structures, even for application for holding other types of items, either during usage, or for storage.

Examples of the early type of use of bracketing arrangements, as for example, that may be fastened to the rim or gunwale of a boat, and held in position by means of its sockets, can be found in the early patent to Adams, Jr., U.S. Pat. No. 3,422,829. While the overall principle of the lifeboat cover as shown in this patent may provide coverage for a boat, the actual structure of the bracketing means, and the framework involved, is distinct from the current invention.

The patent to Stubbmann, U.S. Pat. No. 3,978,610, shows a mobile holding device. This is a mobile device for use for supporting upon a crib, or its crib wall, and is held in place by means of a series of elastic clips as can be seen from the spring clips as disclosed in this patent. These types of clips, as to be seen, hold the housings in place, that support the arch of the tube that functions as a support for the mobile items.

The patent to Kirby, Jr., U.S. Pat. No. 4,878,642, shows an object support for attachment to a cylindrically shaped support member. This disclosure shows a clamp member, that is generally C-shaped, and is used for clamping onto a supporting member, and then for application for holding a variety of other components, one of which is even defined and shown as a support for a plurality of different diameter fishing poles. It can also be seen that this device can be used for holding a can, drinking glass, cup, or the like. The concept of utilizing a C-clamp for holding a structural support, or holding other accessories, is certainly shown in this earlier patent to Kirby. But, this specific structure, and variety of methods of usage, particularly in the marine field, is what is quite distinct from the current invention when viewed in comparison to the overall attachment as disclosed in this Kirby patent.

The patent to Steward, U.S. Pat. No. 4,979,456, shows a portable blind for attachment to a boat. It includes a series of interconnecting frames or attachment means, which are secured by means of U-shaped brackets, to the side walls of a boat. Hence, this patent does disclose the usage of various types of clamp members, to hold the framework onto gunwales of a boat, and in this instance, for supporting the camouflaged material.

The patent to Shillington, U.S. Pat. No. 5,005,793, shows a pole clip needle cap holder. This is a clip for holding a cap to an IV needle, or the like. It simply shows a C-clamp having arms that extend outwardly, for attachment or mounting onto a supporting pole.

The patent to Ennis, U.S. Pat. No. 5,069,416, shows a display fixture for spectacles. This device also shows a C-type clamp, for use with a different type of holder, and for a different purpose.

The patent to Hughes, U.S. Pat. No. 5,167,353, shows a "U" post bracket for bicycles. This bracket also provides a C-clamp, at its lower end, for clamping apparently onto some rod-like portion of a bicycle, such as the seat post, as can be noted.

The patent to Sinohuiz, U.S. Pat. No. 5,356,107, shows a beverage container holder. This holder incorporates a C-clamp, and which can be clamped onto the leg of a chair, as noted. While this disclosure provides a showing of a C-clamp, the type of beverage container holder is quite distinct from the current invention.

The patent to Clews, U.S. Pat. No. 5,642,557, shows a panel display system. This panel display system includes a clip, forming a C-clamp, which may be affixed to a post, and then has extending from its lower common connecting member the various jaws for clamping onto paneling material. The current invention is not concerned with a panel display system.

The patent to Cooper, U.S. Pat. No. 5,697,591, discloses an ornament holder for a Christmas tree. It includes a pair of C-clamps, connected together at a perpendicular angle, and for holding ornaments, or the like, in place.

The patent to Meeker, et al, U.S. Pat. No. 5,704,576, shows a clip for a child exerciser/rocker. This is a rather different type of clip, for use for an entirely different purpose than the current invention.

The patent to James, U.S. Pat. No. 5,857,477, shows a portable car port. This is a quite distinctly appearing device, from that of the current invention, and includes a locking mechanism that mounts or attaches onto the wheels of a vehicle, and functions as a covering for an automobile.

The patent to Rex, et al, U.S. Pat. No. 5,887,539, shows a boat mounted blind. This device shows a frame, which appears to fasten by means of clips to the gun wale of a boat, and which holds the covering material in place, once assembled. The device of this framework is a pivotally attached device, connected to the side rails of the boat, which is not the same type of structure of the current invention.

The current invention, as previously commented, provides a peculiar and novel type of clamp, that can be assembled or built upon itself, with related structure, for use for holding a variety of accessories in place.

BRIEF SUMMARY OF THE INVENTION

This current invention contemplates the formation of a specific style of bracket fitting. It is a fitting that is made out of various types of angles or sections, such as of the PCV pipe category, and which can be assembled into various types of supporting structures. As can be noted, the bottom T-section has a cut out portion along its length, but the cut portion is beyond the center point, so that part of the T may snap directly onto the gunnel or side rail of a boat, as for example when the bracket is used in conjunction with a marine vessel, or it can secure to any other type of supporting structure, and be firmly held in place, as can be understood. In one embodiment, a plug or cap may fit into the upper end of the T, and a hole may be provided therein, and can be used for supporting, for example, another bracket, or a light may be bolted thereon, as can be noted. Thus, when used with a light, or used as a light bracket, it can be secured directly to the gunnel of the boat, and provide either illumination as required for steering, or perhaps even furnish fog light attributes, as when that may be required in an emergency situation. Or, it may hold a spot light in place, as for example when the fisherman is fishing, frogging, or gigging for other aquatic life.

In addition, a second T may be secured to the initial bracket T, as through an intermediate sleeve, and oriented at a particular angle for holding a fishing rod in place, as can be noted. Thus, a series of such brackets could be applied to the side rail of a boat, and hold a variety of fishing poles in place, as used. In many states, a single fisherman may use as many as three rod and reels, or fishing poles, when participating in such piscatorial pursuits.

As can further be noted, additional PVC pipe or other related piping may be fabricated into the structure of the framework, that may extend upwardly, and angularly inwardly, and join in an apex, with the framework from the opposite side of the boat, and thereby form a fabricated framework, in place, throughout a significant length of the boat, and then covered with a camouflaged material, which may be located upon the framework, so that the boat may be used as a duck blind, as on the water. Or, when the boat is moored, onto the dock, or pulled up onto the shore, such framework may support other waterproof covering material, so that the boat could even be used to accommodate overnight sleeping, as when docked, or when supported on a trailer, if the hunter or fisherman desires to use it for that purpose. In addition, the cover may simply provide just that, protection for the boat when stored, either on land or water.

It is, therefore, the principle object of this invention to provide a unique bracket that is of universal construction and can be secured to the gunnel or side rails of most John boats, or other boats, and provide a supported fitting type bracket for use on a boat or other structures for holding a variety of accessories.

Another object of this invention is to provide for a bracket that can be snap fitted and resiliently clamped onto the side rail of a boat or other structure.

Yet a further object of this invention is to provide a bracket that can accommodate other structural tubular like components, in its assembly, and for use for securement thereto of a variety of other accessory products.

These and other objects may become more apparent to those skilled with the art upon reviewing the summary of this invention, and upon undertaking a study of the description of the preferred embodiment, in view of the drawings.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
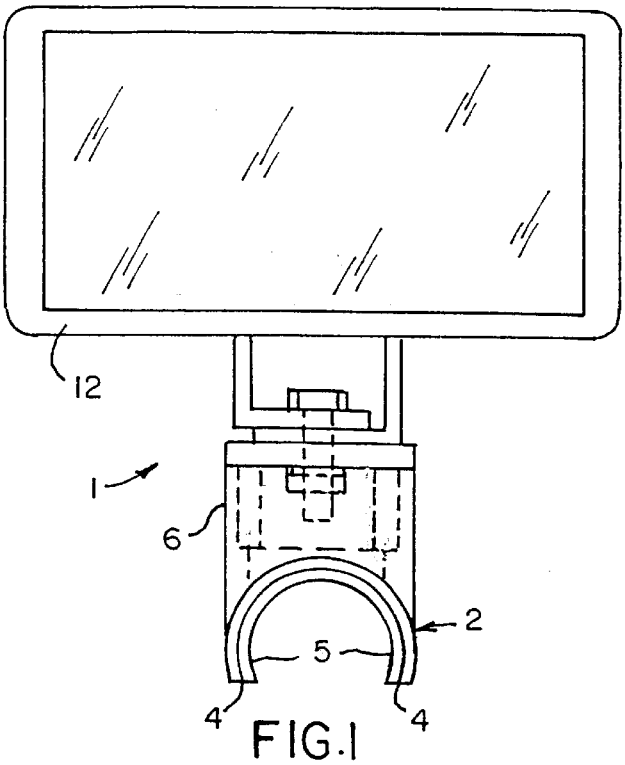
FIG. 1 shows a front view of a fitting bracket of the present invention holding a light or lamp in place.
Figure 1A:
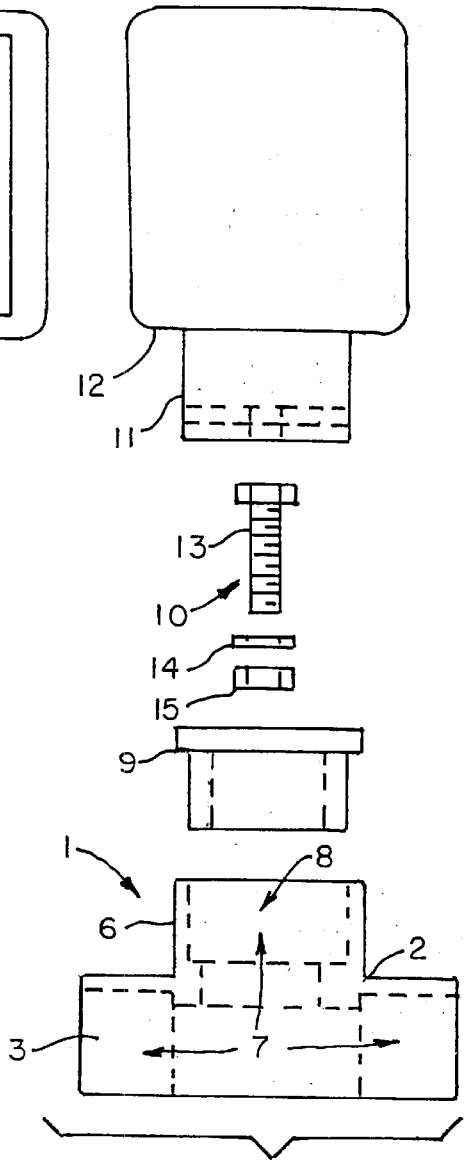
FIG. 1A is a exploded side view of the fitting bracket, with lamp, as disclosed in FIG. 1.

In referring to the drawings, and in particular FIGS. 1 and 1A, the fitting bracket 1 of this invention is disclosed. It comprises a standard T-type fitting 2, which normally has a short length of pipe, as at 3, but in this particular instance, the pipe has been cut below its center point, as at 4, so as to provide a slight inwardly directed curved segment 5 that may resiliently snap onto a supporting rail, such as the gunwale or gunnels of a John boat, or any of the style of bass boats available, as known in the art. Thus, the initial universal style of connection, to a supporting rail, can be achieved through this segment of the T-section, through its inherent resiliency, in the vicinity of its curved ends 5, to allow for the snapping onto a support, rod, or side rail of a boat, as can be understood.

Extending upwardly from the integral tubular section 3 of the bracket, is the upright T-portion 6, which projects up only for a short distance, as can be noted. As is further known in the art, all of these tubular segments 3, and the upright segment 6, as fabricated, have hollow interiors, as at 7, so that the upper open end 8 of the upwardly and perpendicular extending T-segment 6, has its opening therein, and can accommodate the insertion, and permanent securement or otherwise adhesively securing of the closure cap 9, as can be seen. Once permanently affixed therein, the fitting bracket then provides a lower segment that may be snap attached onto the side rail of a John boat, or the like, and the upper cap segment 9, which will be permanently affixed within the T-section 2, by means of the standard PVC or other adhesive, can have an aperture drilled therein, for securement of a fastener 10 therethrough. The fastener 10 may accommodate the securement of a lower bracket 11 of the shown lamp, light, fog lamp, or other illuminating device 12, as noted. The fastener 10 includes the usual bolt 13, washer 14, and nut 15, or any other type of fastener, that may secure these two components together.

The fitting bracket of this invention also may be used as an attachment point for oar locks, by simply providing an aperture through the upper portion of the cap section 9, and into which the stems of the oar lock may insert, for immediate and prompt affordable usage of boat oars, at any location upon the length of the John or other boat.

In the assembly of the fitting bracket, developed from a series of T-sections, the concept is to modify, in the specific embodiment, a one inch diameter PVC pipe, of the type normally used in plumbing, for water lines, etc. The T fitting is modified to allow for it to be snapped onto the one inch gunwales of an aluminum John boat. Other sizes of T fittings could be used on other size gunwales, or side rails, for a boat. For example, it is known in the art, that some gunwales have a diameter of approximately one and a quarter inch, rather than just one inch, as normally encountered. The modified T is made by making two parallel lengthwise cuts in the bottom of the T, at approximately at the 105° angle from the center, and directly opposite from the other pipe opening. The remaining material, or the remaining portion of the T, which is yet an over center arranged portion, allows the T to snap down unto the gunwale securely, but yet can be fairly easily removed, or moved, as may be necessary, due to its inherent resiliency. By altering where the material is removed, one can change how far the T will rotate either inboard or outboard, as may be desired, particularly where the fitting bracket may be used for holding a fishing rod in place, which desirably will be angulated upwardly, when fitted into the T-section forming that style of bracket. In addition, it may be desirable to apply a double faced type of pressure sensitive adhesive tape to the gunwale, before the T-section for the fitting bracket is applied, in order to help keep the T from moving, and secure it in place, once installed.

Another benefit of this invention is that the attachment or fitting bracket can be used as the basis for attaching any number of items to an aluminum John boat, without permanent modification to either the side rails or gunwales of the boat, or to the bracket itself. Hence, there is no need to drill any holes, apply any bolts, rivets, or other clamps, to the bracket, when used.

Figure 2:
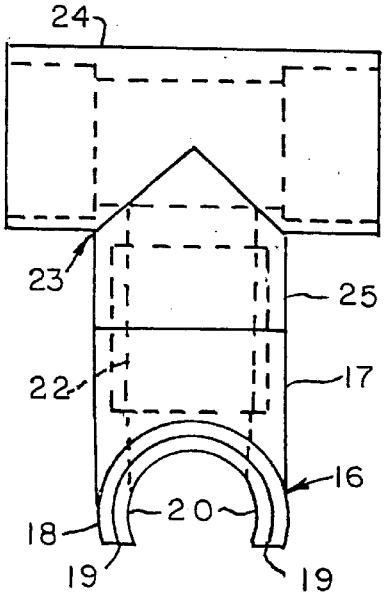
FIG. 2 is a front view of the fitting bracket, modified through the addition of further sleeves and T-sections, to provide a perpendicular arranged support for holding a fishing rod, or the like, in place.
Figure 2B:
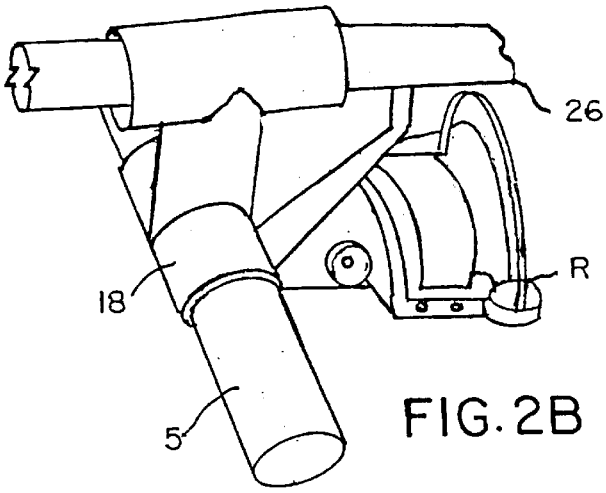
FIG. 2B a perspective view of the fitting bracket of FIG. 2, shown holding a fishing rod and reel.
Figure 2A:
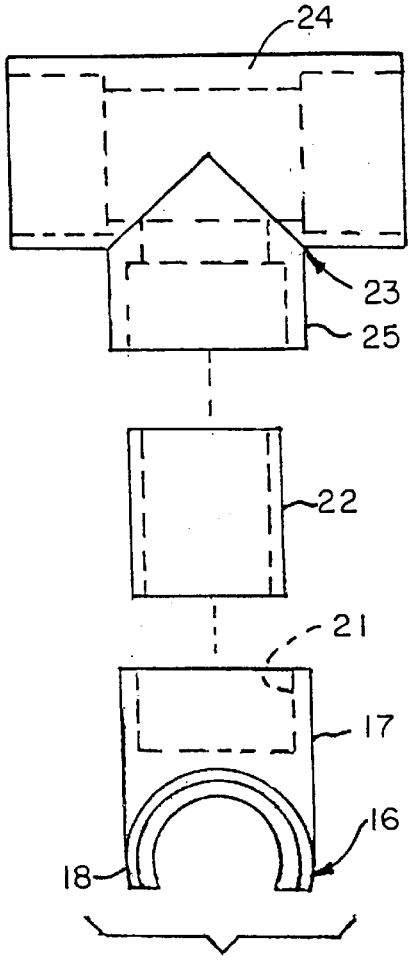
FIG. 2A is an exploded view of the fitting bracket of FIG. 2.

Another variation upon the fitting bracket of this invention can be seen in FIGS. 2–2B. As noted, the lower T-section 16 includes the upright portion of the T 17, similar to that as previously explained with respect to section 6 for the T-fitting of FIG. 1A. The lower tubular section of the T, as at 18, is cut below the center line, as noted, as at 19, so as to provide an over center type of clamping mechanism 20, at the lower segment of the cut T, to allow for its resilient clamping onto the side rails of the John boat, as can be understood.

The upper section 17 of the T fitting, within its interior, is designed to accommodate within its central opening 21, a short length of PVC or other material sleeve 22, which may be adhesively secured therein, by any type of adhesive, as know in the art. The upper end of the sleeve 21 inserts within and cooperates with an upper T 23, which as can be seen also incorporates a tubular section 24, which is horizontally disposed, having integrally formed extending from an intermediate portion the segment 25, which accepts the sleeve 22 therein, and which is adhesively secured, for forming the double T-style of fitting bracket as shown. Thus, when fabricated in this manner, the bracket may be secured, once again, as by attachment of its resilient section 18 to the side rail of a John boat, or the like, tilting the same slightly inwardly, so as to arrange the upper tubular section 24 of the upper T 23 at an angle, for accommodating the insertion of the handle 26 of a fishing rod and reel R, supported thereto, upon installation. See FIG. 2B. As can be noted, the lower T-section 18 is herein shown snap clasping onto the side rail S of the John boat, or other structure. For example, the rail may be included on a chair, so that the fisherman can sit in the chair, and direct his rod and reel outwardly over the water, as when bottom fishing, as known.

The T fittings can also be used, for example, to secure a complete framework, to the upper edges of the John boat. The framework can be covered with a fabric covering so as to form a duck blind frame over the boat. In addition, such a frame, after the cover has been quickly removed, is yet capable of being trailered behind a van or other vehicle and even up to high speeds in the vicinity of 70 miles per hour, without collapsing, since the framework itself offers very little wind resistance, during transit. The framework, which is preferably made from interfitting pipe sections (such as PVC pipe) itself can easily be dismantled, and stored in a duffel bag about the size of a golf bag. In addition, the T-type fitting brackets of this invention may be applied to an automobile framework, for holding fog lights in place, upon the vehicle during usage. It can function as a fishing rod holder, as described herein, and can attach around the upper perimeter of a boat, to hold a cover in place, for protection purposes, while the boat is docked, or when pulled onto the shore. Or, as previously explained, such a cover may provide a form of housing to allow the fishermen to reside and sleep in the boat, as overnight, to add to the affordability of their accommodations, at the site of hunting, when used.

Figure 3:
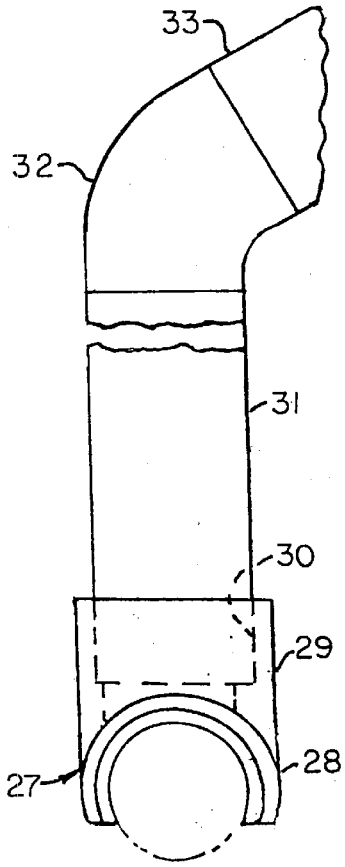
FIG. 3 is a front view of the fitting bracket of the invention, having an upwardly extending framework secured therein, and which may form the overall framework for a boat, or the like, for holding a cover, camouflage, or other canvas for draping over a boat, or other structure.
Figure 4:
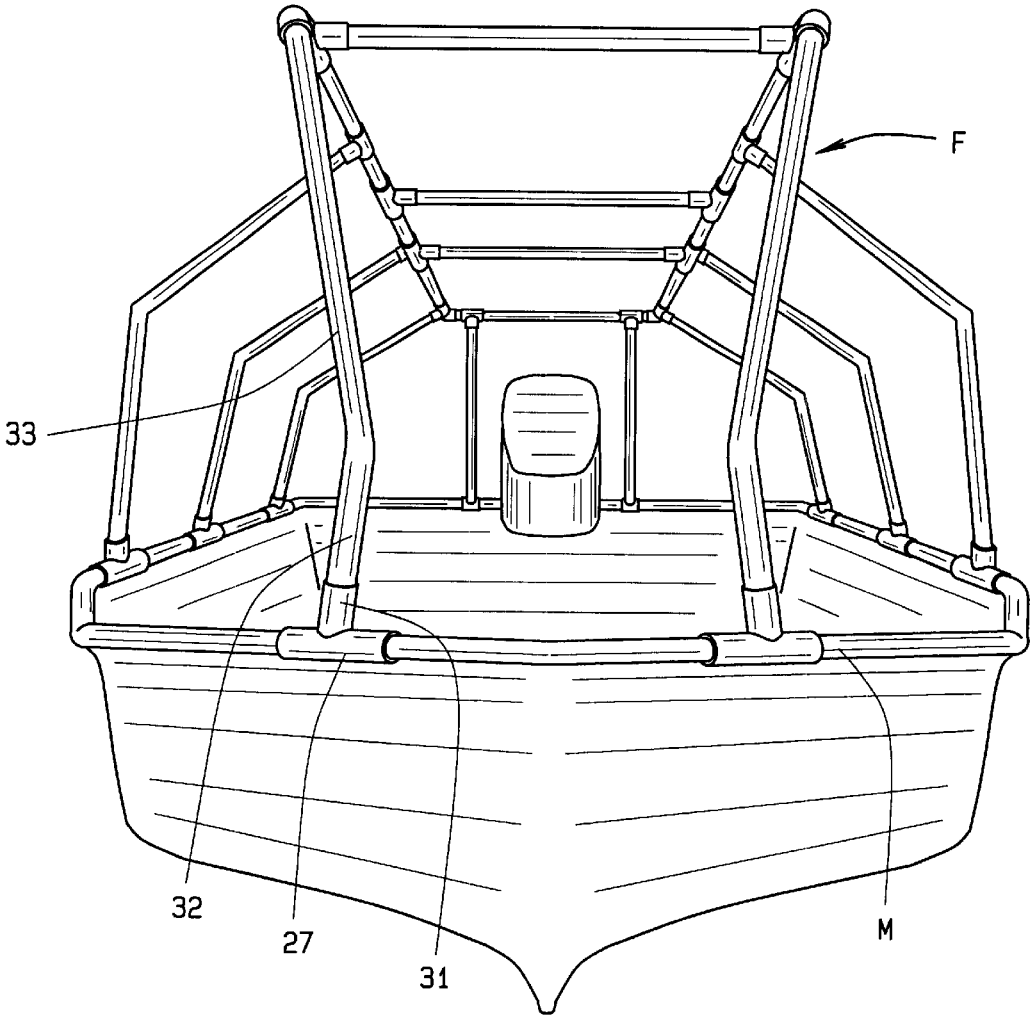
FIG. 4 is a front elevational view of a John boat having a frame work mounted thereon using fittings of the present invention and with a camouflage covering draped around the bottom of the framework.

When used as a framework for a boat cover, or camouflaged material, as for preparation of a blind for duck hunting, using the boat itself, reference is made to FIG. 3, which shows the formation of the fitting bracket from a modified T, as at 27. This includes the lower tubular section 28 of the T being cut, below center, to provide for its snap clasping onto the side rails of the boat, when installed. The upper perpendicular integral section of the T, as at 29, within its interior central cavity 30, is designed for fitting therein, temporarily, the various framework members 31 comprising the linear sections as shown, coupling with an elbow 32, for directing another section 33 angularly upwardly towards the center of the boat, which may connect with additional framework to form a supporting framework F, elevated from the surface of the boat, to accommodate the application and draping of any camouflaged material M thereon, as when the boat is being used as a duck blind, or any other covering, as when the boat is to be stored, or used for accommodating the hunter for meals, resting, or sleep, as previously explained. This simply shows an additional feature of the usage of the fitting bracket of this invention, for adding versatility to the use and application of the boat, or other vehicle, or even other supporting structures, for use for holding accessories, whether they be lamps, fishing rods, covers, or other endless and related uses. These are just examples of the versatility of the bracket of this invention.

Variations or modifications to the subject matter of this invention may occur to those skilled in the art upon reviewing the development as described herein. For example, the cap 9 (FIGS. 1–1A) need not be glued or otherwise secured into the T section 6, such that various attachments can be mounted in the same bracket section 1. For example, this would allow for switching the type of light that is mounted in the bracket fitting 1. The shaft 13 for the light 12 and the oar stem can be secured in the fitting cap 9 by conventional means other than a bolt which is received on a threaded end of the stem. For example, the cap hole, itself, could be threaded; alternatively, a cotter pin could extend through the stem or set screws could pass through the fitting and engage the stem to hold the stem in place. Alternatively, the stem could simply be placed in the opening of the cap 9, such that the light or oar can be easily removed from the fitting. Such variations or modifications are set fort for illustrative purposes only, and are not meant to be limiting.

What is claimed is:

1. A bracket fitting formed of PVC components and for securement to the gunwale of a boat, and for use for mounting one of a light, fishing pole, or a framework for supporting a boat cover, to the boat; said bracket fitting comprising a T-shaped fitting having a horizontal bottom section and an integral hollow tube extending up from the bottom section, the bottom section comprising a tube defining an arc of more than 180° and having a radius slightly larger than the radius of the gunwale such that the bottom section can be snap-fitted onto the gunwale to mount any instrument to the gunwale without the use of fasteners which penetrate the gunwale, said bracket fitting further including a cap, which is received in the hollow tube, said cap being adhesively secured in said hollow tube, said cap having an opening formed therein, the instrument including a stem sized and shaped to pass through said cap opening to support one of the instruments to said bracket fitting, and a fastener, cooperating with the instrument stem, to secure one of the instruments to the bracket fitting and onto the gunwale of a boat.

2. The bracket fitting of claim 1 including a fastener for securing said instrument stem in said cap.

3. The bracket fitting of claim 2 wherein said stem is at least partially threaded, said fastener securing to the threads of said stem.

4. A bracket fitting formed of PVC components and for mounting an instrument such as a fishing pole, to the gunwale of a boat, said bracket fitting comprising a T-shaped fitting having a horizontal bottom section and a hollow tube extending up from the bottom section, the bottom section comprising a tube defining an arc of more than 180° and having a radius slightly larger than the radius of the gunwale such that the bottom section can be snap-fitted onto the gunwale to mount the fishing pole to the gunwale without the use of fasteners which penetrate the gunwale, said fitting including a second T-member which is mounted to said first T-shaped fitting, said second T-member including a hollow leg which is mounted to said first T-shaped fitting hollow tube, and a generally horizontal tubular section integrally connecting with the said hollow leg, a connecting member, said connecting member being received in the hollow tube of the T-shaped fitting, and said connecting member being connected to the second T-member hollow leg, whereby the tubular section of the second T-member being sized and shaped to receive a handle of a fishing rod.

5. A plurality of bracket fittings formed of PVC pipe components and for use for mounting a cover upon a framework to a boat, said bracket fittings provided for mounting to the gunwale of a boat, each bracket fitting comprising a T-shaped fitting having a horizontal bottom section and a hollow tube extending integrally upwardly therefrom, the bottom section of each bracket fitting comprising a tube defining an arc of more than 180° and having a radius slightly larger than the radius of the gunwale such that the bottom section of each bracket fitting can be snap-fitted onto the gunwale to mount the cover framework to the gunwale without the use of fasteners which penetrate the gunwale, said cover including a framework of PVC pipe components, said framework comprising a plurality of said bracket fittings, and a plurality of interfitting tubular sections and angled sections, said framework tubular sections being received in said hollow tubes of said bracket fittings, said tubular sections and angle sections being connectable together to form a supporting framework for mounting the cover to a boat.

6. The bracket fittings of claim 5 wherein said tubular sections are removably mounted in said bracket fittings; and said tubular sections and angle sections are dissassemblable from each other for removal.

* * * * *